US007708916B2

(12) United States Patent
Schwoerer

(10) Patent No.: US 7,708,916 B2
(45) Date of Patent: May 4, 2010

(54) DEVICE AND METHOD FOR DISPLACING A FLOOR TABLE MOLD

(75) Inventor: Artur Schwoerer, Senden (DE)

(73) Assignee: PERI GmbH, Weissenhorn (DE)

( * ) Notice: Subject to any disclaimer, the term of this patent is extended or adjusted under 35 U.S.C. 154(b) by 985 days.

(21) Appl. No.: 10/576,525

(22) PCT Filed: Nov. 3, 2004

(86) PCT No.: PCT/DE2004/002426

§ 371 (c)(1),
(2), (4) Date: Apr. 20, 2006

(87) PCT Pub. No.: WO2005/045160

PCT Pub. Date: May 19, 2005

(65) Prior Publication Data

US 2007/0094962 A1 May 3, 2007

(30) Foreign Application Priority Data

Nov. 3, 2003 (DE) ..... 103 51 257

(51) Int. Cl.
*E04B 1/16* (2006.01)

(52) U.S. Cl. ..... 264/33; 294/67.1; 414/10; 425/62

(58) Field of Classification Search ..... 52/125.1–125.6, 52/127.7, 127.8, 127.12; 414/10–12; 264/33, 264/34; 294/67.1, 67.2
See application file for complete search history.

(56) References Cited

U.S. PATENT DOCUMENTS 3,450,280 A * 6/1969 Colnot ..... 414/10
3,787,020 A 1/1974 Avery
3,788,494 A 1/1974 Markewitz
3,977,536 A * 8/1976 Moore et al. ..... 414/11
4,462,951 A * 7/1984 Martin ..... 264/33

FOREIGN PATENT DOCUMENTS

| | | |
|---|---|---|
| DE | 1 759 904 | 7/1971 |
| DE | 17 59 904 | 7/1971 |
| DE | 66 10 237 | 7/1973 |
| FR | 1 207 200 | 2/1960 |
| FR | 1 216 442 | 4/1960 |

(Continued)

OTHER PUBLICATIONS

"Flying Procedure", Form-EZE Systems Inc.

*Primary Examiner*—Richard E. Chilcot, Jr.
*Assistant Examiner*—Matthew J. Smith
(74) *Attorney, Agent, or Firm*—Paul Vincent

(57) ABSTRACT

A floor table (1) of a concrete mould for producing a concrete floor (2), comprising at least one front (18, 19) and one rear holder (23) for fixing at least one front (11) and at least one rear ligament (12) of a crane harness (9), characterized in that when the floor table (1) is in a disengaged and retracted state underneath a recently hardened concrete floor (2), it is possible to have access to the holders (18, 18 23) which are used to fix the ligaments (11, 12). The inventive floor table can be drawn out from the floor and displaced with less danger to the workers and requiring less effort in comparison with conventional floor tables.

21 Claims, 4 Drawing Sheets

FOREIGN PATENT DOCUMENTS

| | | |
|---|---|---|
| FR | 2 186 994 | 1/1974 |
| FR | 2 209 382 | 6/1974 |
| FR | 2 253 901 | 7/1975 |
| FR | 2 403 434 | 4/1979 |
| GB | 1 021 106 | 2/1966 |
| NL | 7 410 525 | 2/1976 |

* cited by examiner

DEVICE AND METHOD FOR DISPLACING A FLOOR TABLE MOLD

This application is the national stage of PCT/DE2004/002426 filed on Nov. 3, 2004 and claims Paris Convention priority of DE 103 51 257.8 filed Nov. 3, 2003.

BACKGROUND OF THE INVENTION

The invention concerns a floor table of a concrete formwork for producing a concrete floor, comprising at least one front and one rear holder for mounting at least one front and at least one rear ligament of a crane harness.

Floor tables of this type are disclosed in U.S. Pat. No. 3,787,020. The displacement of such floor tables is disclosed in the company document "Flying Procedure" of FORM-EZE Systems Inc.

Concrete formworks are used to build concrete buildings. The formwork thereby defines a space for liquid concrete and can be removed when the concrete has hardened.

So-called floor tables are conventionally used to produce concrete floors. Floor tables have a relatively large, flat formwork surface, e.g. of a format of 6×24 m. Assembly and disassembly of a floor formwork using floor tables requires only a few, but complex assembly steps, and, in particular, a crane for displacing the floor tables.

The conventional construction of a storey of a building using floor tables is described below.

A floor table comprising i.a. an upwardly facing formwork surface is positioned onto a floor surface. The floor table is initially roughly positioned, generally by means of a crane. Further horizontal positioning is realized by roller means, such as assembly trolleys, articulated rollers, rigid rollers, tank rollers etc. The upper edge of the formwork surface is then disposed at a distance from the upper edge of the floor in correspondence with the room height to be produced, wherein spindles or hydraulically actuated lifting means are conventionally used to vertically adjust the floor table. Further floor tables and/or vertically oriented formwork elements are disposed at the edges of the floor table and corresponding reinforcing materials are disposed on the floor tables. Liquid concrete is subsequently poured into and distributed on the formwork surface of the floor table and is left until the concrete, i.e. the concrete floor to be produced, has hardened.

After hardening, the formwork is at first removed from the floor table and the floor table is lowered relative to the hardened concrete floor, e.g. by using the above-mentioned spindles. The stroke of the lowering motion should be minimum to save assembly time. The floor table is disposed on roller means. The floor table without formwork is then manually displaced in a horizontal direction by technicians, such that the floor table projects beyond the hardened concrete floor. Holders for the ligaments of a crane harness are provided on the upper side of the floor table on both sides of the center of gravity. As soon as the floor table has been pushed out to a sufficient degree, such that at least a first part of these holders projects outward from below the hardened concrete floor, a technician climbs onto the upper side of the floor table and fastens the ligaments of a crane harness to the exposed holders, optionally with the technician standing on the formwork surface and opening flaps therein. If necessary, the floor table is pushed further out until the remaining holders also project from below the hardened concrete floor, and a technician, standing on the formwork surface, fastens the other ligaments to the holders.

According to FORM-EZE Systems Inc., the floor table is extracted directly from underneath the hardened concrete floor to such an extent that all holders on the upper side of the floor table are exposed to allow the technician to fasten all ligaments of the crane harness. Usually, the floor table is as wide as the hardened concrete floor and the center of gravity of the floor table must be displaced beyond the edge of the floor. As a result, the floor table tilts and its inner, upper edge must be supported on the lower side of the hardened concrete floor.

When the crane harness has been completely fastened, the ligaments can be tightened and further conventional handling of the floor table using a crane is possible. The floor table is then completely extracted or pivoted out of the region between the floor and the hardened floor and is lifted and disposed on the hardened floor. The hardened floor may then serve as floor for adding on a further storey.

When displacing a floor table as recommended by FORM-EZE Systems Inc., the crane harness can be mounted directly above the center of gravity of the floor table immediately after assembly.

One disadvantage of this prior art is that the technician may have to walk on an inclined formwork surface of a floor table in order to fasten the ligaments. The section of the floor table on which the technician moves, projects past the hardened concrete floor and typically also beyond the floor, such that the worker must be specially secured for this work. The surface of the floor table may be moist and slippery after removal of the formwork, in particular, due to formwork oil and condensed water. Another disadvantage is the fact that it requires considerable effort to horizontally displace the floor table, i.e. the manual labor of several technicians.

In contrast thereto, it is the object of the present invention to provide a floor table which can be moved out from beneath a floor and displaced with less expense and increased safety for the technicians.

SUMMARY OF THE INVENTION

This object is achieved in accordance with the invention with a floor table of the above-mentioned type in that the holders for mounting the ligaments are accessible in the non-retracted state of the floor table without formwork beneath the freshly hardened concrete floor.

All ligaments of the crane harness are conventionally fastened to the holders of the floor table only when the holders project beyond the hardened concrete floor. The holders are correspondingly designed for use in the exposed state only, i.e. when they are no longer covered by the concrete floor.

In contrast thereto, the present invention teaches design of the holders in such a manner that free access from the upper side of the formwork surface, which is not covered by the newly produced concrete floor, is no longer required in order to use the holders, in particular, for mounting of the ligaments. This means that, in accordance with the invention, the crane harness can be completely fastened before the crane holds the floor table in opposition to the force of gravity. The ligaments may be mounted to the holders directly after removing the formwork and lowering the floor table, i.e. prior to any horizontal displacement of the floor table. A ligament to be fastened is thereby preferably guided between formwork surface and the lower side of the hardened concrete floor, and a holder which can be handled substantially from the lower side of the floor table, is connected to the end of the ligament. A particular mechanism, i.e. a hook or carbine may be provided at the end of the ligament. The holder may e.g. be designed as loop or pin, in particular, having a constriction or thickening, or as a mounting point having a different design.

Since, in accordance with the invention, the floor table can be connected to the crane harness and thereby to the crane before the floor table is horizontally displaced, it is fundamentally possible to use the crane for horizontal displacement of the floor table. The force of the crane may thereby replace the manual force of the technicians for extracting the floor table from underneath the hardened concrete floor. Within the scope of the invention, the holders are therefore suited for both vertical (tensile force from above) and horizontal loads (tensile load towards the crane side in the extension direction) and are designed accordingly.

One embodiment of the inventive floor table is particularly preferred, with which the holders of the floor table are accessible for mounting the ligaments when the floor table is lowered relative to the concrete floor by 50 cm or less, in particular 30 cm or less. The lowering motion is preferably minimized, i.e. corresponding to the space requirements for a mechanism at the end of the ligament to be mounted, i.e. the space required by the holder. This saves assembly time, and the lifting and lowering devices (spindles, jacks, hydraulic cylinders etc.) can be minimized in size, thereby reducing costs.

In a particularly preferred embodiment of the inventive floor table, at least one holder is designed as a bollard which can be extended from a formwork surface of the floor table towards the concrete floor, wherein, in particular, the upper side of the bollard terminates flush with the formwork surface in the advanced state, and wherein the bollard comprises a constriction or thickening in the region of its end facing the concrete floor. The bollard is a mounting pin or bolt. The bollard can be extended and retracted from the lower side (i.e. the side facing away from the concrete floor) of the floor table, i.e. using a mechanical spindle. A suitable latch shoe is disposed at the end of the ligament to be mounted for engagement with the bollard. The bollard and latch shoe provide simple and safe fastening.

A further embodiment is characterized in that the floor table comprises at least one working platform at its edge, wherein at least one holder is disposed in the region of the at least one working platform. The working platform is preferably disposed on the side towards which the floor table is outwardly displaced. The working platforms may be tilted away. In the retracted state of the floor table, the working platform projects past the edge of the hardened concrete floor. A holder which is disposed in the region of a working platform can be accessed per se after removal of the formwork and, in particular, even in the inserted state of the floor table.

In a further embodiment of the inventive floor table, a formwork surface of the floor table comprises at least one flap, wherein the flap preferably terminates flush with the formwork surface in the closed state, wherein the flap can be opened from the side of the floor table facing away from the concrete floor, and a ligament of the crane harness can be guided through the open flap, wherein this ligament can be mounted to a holder which is disposed on the side of the floor table facing away from the concrete floor, wherein, in particular, a deflecting device is mounted to an edge of the open flap. The flap preferably opens in a downward direction (away from the concrete floor). The holder is provided in the vicinity of the flap below the concrete formwork. A flap to be opened from below may also be provided in the formwork surface to obtain the same effect, and a holder of the floor table may be partially guided through the open flap from the bottom to the top, i.e. through pivoting, and the ligament can be mounted to the holder projecting from the formwork surface.

In a preferred embodiment, the at least one holder is disposed on the side of the floor table. A sideward holder is easy to construct and easily accessible in almost any position of the floor table. A sideward holder may predominantly be disposed on a vertical side wall of the floor table, in particular, on a long side wall.

The present invention also concerns a device for displacing an inventive floor table, comprising a crane harness with at least two ligaments for mounting to the holders of the floor table, wherein at least one front ligament is provided which is designed to be mounted to a front holder of the floor table which is remote from the concrete floor during displacement, and wherein at least one rear ligament is provided which is designed to be mounted to a rear holder of the floor table which is close to the concrete floor during displacement, and also comprising a relocating unit in which the crane harness is suspended, and at least one roller means on which the floor table can be horizontally displaced when the formwork has been removed, and characterized in that the device comprises at least one deflecting device for mounting to an edge of the hardened concrete floor, wherein the device, in particular, the relocating unit, comprises means for shortening the at least one rear ligament.

This device utilizes a crane for horizontal removal of a floor table from below a storey, after removing the formwork. A force may be exerted by the rear holder, facing away from the crane, on the floor table through lifting the relocating unit, which displaces the floor table horizontally towards the crane or the relocating unit. The same force may be exerted through shortening the rear ligament. The rear ligament is also shortened to move the relocating unit past the center of gravity of the floor table to permit further handling of the floor table by the crane. The means may preferably both shorten and extend the rear ligament to correct any improper operation.

The deflecting device to be mounted to an edge of the hardened concrete floor prevents damage to this edge by the sliding rear ligament. The rear ligament may e.g. be designed as steel chain with large links. The deflecting device moreover ensures sliding of the rear ligament with little friction. The deflecting device is preferably designed as a deflecting sheet which can be mounted to the edge of the concrete floor like a screw clamp. The deflecting sheet may have the shape of a cylinder jacket. The deflecting device may also be designed as deflecting roller.

In a particularly preferred embodiment of the inventive device, the device, in particular, the relocating unit comprises means for lengthening the at least one front ligament. This simplifies the horizontal orientation of the floor table during extraction. The means may preferably both shorten and lengthen the front ligament to correct any improper operation. The means for shortening the front ligament can be omitted when the length of the front ligament (distance between the front holder and the relocating unit) is larger than the separation between the front holder and the center of gravity of the floor table in the horizontal direction.

In a particularly preferred embodiment of the inventive device, the at least one front ligament and the at least one rear ligament are connected to each other, the connected ligament passing through the relocating unit, and the relocating unit comprises a drive for controlling the passage of the connected ligament. The drive, a motor with or without transmission prevents free sliding of the connected ligament in the relocating unit. The means for shortening the rear ligament and for extending the front ligament are combined and therefore easier to operate. Non-supporting end sections of the ligaments need not be wound up.

In an advantageous further development of this embodiment, the connected ligament comprises a central control ligament in the region of the relocating unit, whose passage through the relocating unit can be controlled by the drive, and a central support ligament which passes through the relocating unit via deflecting devices, in particular deflecting rollers or deflecting sheets, without being braked. The central support ligament accepts part of the weight of the floor table to reduce the load on the central control ligament. This reduces the load on the drive, and even heavy floor tables of a weight of 6 t or more can be controlled with conventional drives. The central support ligament cannot be directly influenced by the deflecting devices. The passage of the central support ligament can be influenced only indirectly via the central control ligament. The central control ligament and central support ligament extend outside of the relocating unit approximately parallel in sections, and are preferably combined at linking or connecting points. The linking points are separated from the relocating unit to a sufficient extent such that all displacing motions required for displacing the floor table are possible, in particular, shortening and extending the front and rear ligaments.

A preferred embodiment of the inventive device is characterized in that the device comprises an electronic horizontal sensor to be mounted to the floor table. The means and/or the motor can be thereby controlled using information from the electronic horizontal sensor, and a horizontal orientation of a floor table mounted to the ligaments can be regulated. The electronic horizontal sensor is designed e.g. as an electronic level. The electronic horizontal sensor facilitates horizontal orientation of the floor table during any displacement, which would otherwise have to be monitored and controlled by a technician.

In one advantageous embodiment, the front ligament is branched into several, in particular two, front partial ligaments for mounting to a corresponding plurality of front holders of the floor table. In another advantageous embodiment, the rear ligament is branched into several, in particular two, rear partial ligaments for mounting to a corresponding plurality of rear holders of the floor table. The partial ligaments secure the floor table from tilting through a multipoint suspension, in particular, a three-point suspension or four-point suspension.

In a preferred embodiment of the inventive device, one or more ligaments are formed entirely or partially from steel chains. Steel chains are particularly tear-resistant, can be wound in a compact form and can be held at a constant length even under a great load by means of a drive. Steel chains can be safely extended and shortened under load.

A particularly preferred embodiment of the inventive device to be used with an inventive floor table according to the embodiment comprising a bollard holder, is characterized in that a latch shoe is disposed at the end of a ligament, the latch shoe comprising a lower part having a recess, the recess being designed to grasp below the thickening or for grasping around the constriction when the bollard has been inserted. The latch shoe comprises a projection which, when the bollard has been completely or substantially inserted, blocks it from moving, in particular, against the direction of insertion of the bollard into the recess. When the bollard has been introduced into the latch shoe and has been inserted to the maximum extent and is fixed therein, i.e. through tightening a spindle at the lower end (facing away from the concrete floor) of the bollard, the ligament is rigidly and safely connected to the floor table. This connection can be easily and quickly realized. The latch shoe may have inclined edges or guides to facilitate insertion into the bollard.

In a further development of this embodiment, the latch shoe comprises an upper part which, when mounted, can be pivoted upwards relative to the lower part, in particular, through a tensile load of the ligament mounted to the latch shoe, and wherein in the upwardly pivoted state of the upper part, a securing pin presses the inserted bollard in the direction of the largely inserted position of the bollard and thereby into the blocked position of the bollard. The securing spin or holding-down clamp prevents inadvertent release of the ligament mounting (i.e. the latch shoe) to the holder (i.e. at the bollard), in particular, when the bollard is only insufficiently fixed in the maximally inserted position or when the position of the formwork surface on which the latch shoe is supported changes under load.

The present invention also concerns a method for displacing an inventive floor table, comprising the following steps:

a) when a concrete floor has hardened, the floor table formwork is removed and the floor table is lowered onto at least one roller means;
b) the at least one front ligament and the at least one rear ligament are mounted in corresponding holders of the floor table while the floor table is located below the hardened concrete floor;
c) the floor table, being supported on the at least one roller means, is removed from below the hardened concrete floor, in particular, using manual labor, wherein a crane keeps the front ligament tightened at a constant length, thereby ensuring a substantially horizontal orientation of the floor table;
d) as soon as the hardened concrete floor no longer projects past the rear holder, the rear ligament is tightened; subsequently, the rear ligament is gradually shortened and/or the front ligament is gradually extended, thereby gradually displacing a relocating unit, to which the ligaments are mounted, towards the center of gravity of the floor table; shortening and/or extension is controlled in such a manner that the floor table remains in a substantially horizontal orientation;
e) as soon as the relocating unit has reached a position above the center of gravity of the floor table, no load acts on the rolling means and the floor table is displaced by the crane for further use, in particular, disposed onto the hardened concrete floor to produce a further storey.

This method may be performed with an inventive floor table and a conventional crane harness or crane. With the inventive method, there is no need for a technician to get onto the upper side of the floor table for mounting the crane harness.

The present invention also concerns a method for displacing an inventive floor table having an inventive device, the method comprising the following steps:

a) when a concrete floor has hardened, the floor table formwork is removed and the floor table is lowered to at least one roller means;
b) the at least one front ligament and the at least one rear ligament are mounted in corresponding holders of the floor table with the floor table being located below the hardened concrete floor, and the deflecting device to be mounted to an edge of the hardened concrete floor is installed on the edge of the hardened concrete wall facing a crane;
c) the relocating unit is pulled upwards by the crane, wherein the rear ligament slides on the installed deflecting device and the floor table automatically moves outward from below the hardened concrete floor. At the same time, at least the means for shortening the rear ligament are controlled in such a manner that the floor table remains in a substantially horizontal orientation;
d) as soon as the rear ligament loses contact with the installed deflecting device, the rear ligament is gradually further shortened and/or the front ligament is gradually extended, whereby the relocating unit is gradually displaced towards the center of gravity of the floor table. Shortening and/or extension are controlled in such a manner that the floor table remains substantially horizontally oriented;

e) as soon as the relocating unit has reached a position above the center of gravity of the floor table, no load acts on the roller means and the floor table is displaced by the crane for further use, in particular, disposed on the hardened concrete floor to produce a further storey, wherein the installed deflecting device is subsequently removed.

This method not only obviates the work of a technician for mounting a crane harness to the upper side of the floor table, but also utilizes the lifting power of the crane for displacing or extending the floor table from a storey, i.e. from below the hardened concrete floor.

In one variant of these two inventive methods, at least one guiding chord is mounted at the end of a ligament during step b), and the end of the ligament is pulled to a holder using the at least one guiding chord and/or oriented relative to the holder. Mounting is facilitated by actuating the holder, e.g. by retracting a bollard or by inserting a hook through a flap of the formwork surface and locking the hook in a loop.

Further advantages of the invention can be extracted from the description and the drawing. The features mentioned above and below may be used in accordance with the invention either individually or collectively in arbitrary combination. The embodiments shown and described are not to be understood as exhaustive enumeration but have exemplary character for describing the invention.

BRIEF DESCRIPTION OF THE DRAWING

The invention is shown in the drawing and explained in more detail with reference to embodiments.

DESCRIPTION OF THE PREFERRED EMBODIMENT

Figure 1:
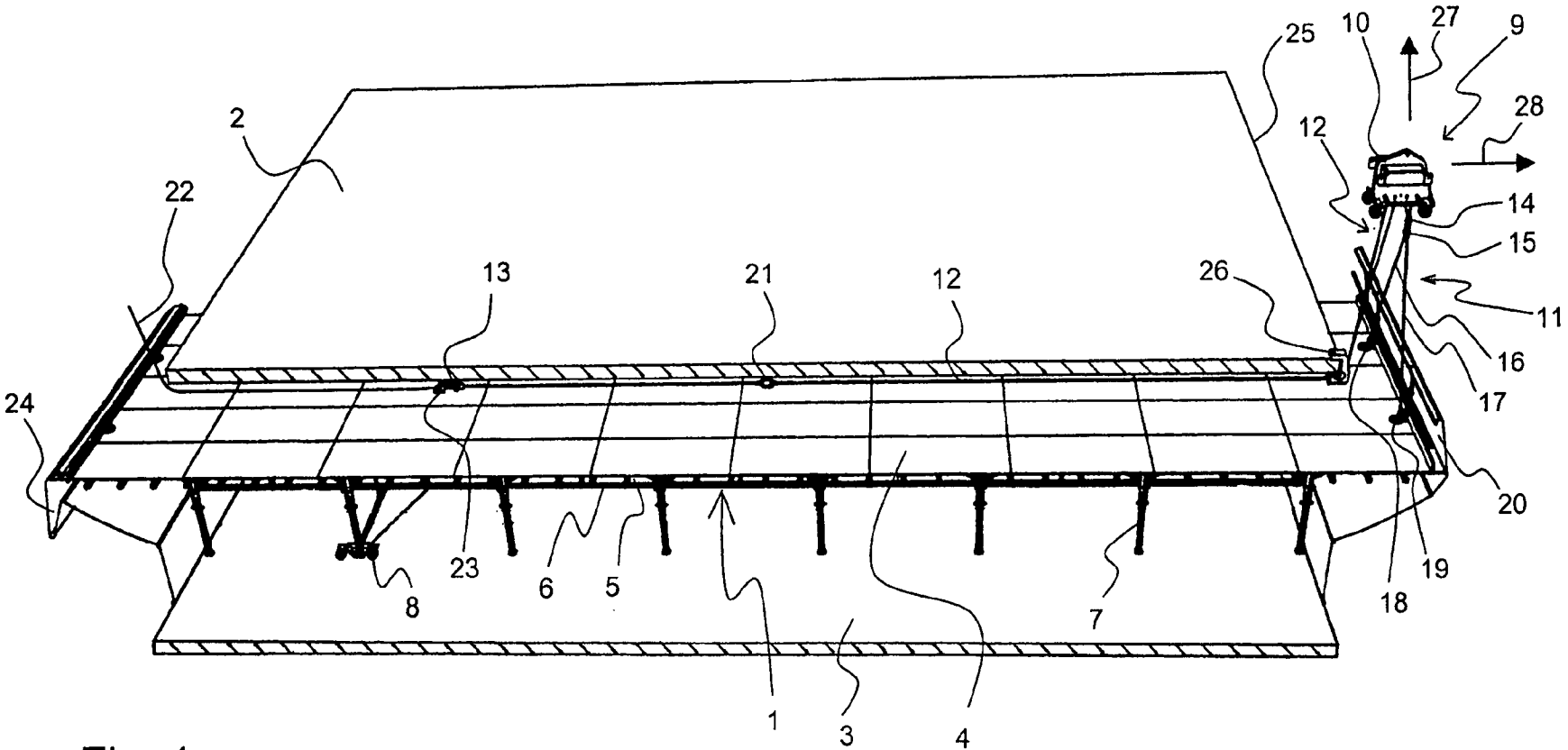
FIG. 1 shows a schematic view of an inventive floor table in the inserted state with the formwork being removed, and with an inventive device for displacing the floor table.

FIG. 1 schematically shows an inventive floor table 1 released from a previously hardened concrete floor 2. The floor table 1 is thereby disposed on a floor 3. The floor table 2 is supported on the floor 3 by concrete posts (not shown). The floor 3 was produced in a previous concrete pouring step as a concrete floor above a floor (not shown) disposed further below. The concrete floor 2 and the floor 3 have identical basic surfaces disposed on top of each other, and delimit a storey of a building that is being built. The concrete floor 3 in FIG. 1 is cut off approximately above the center of the floor table 1 to provide a clear view of the upper side of the floor table 1.

The floor table 1 comprises a formwork surface 4 on its upper side facing the concrete floor 2. The formwork surface 4 is mounted to upper chords of formwork supports. The floor table 1 moreover comprises a truss 5 with a lower chord 6, wherein the formwork supports are connected to the truss 5. When the floor table 1 is in the formwork, the floor table 1 is supported on supporting elements 7, i.e. construction supports which can be operated with spindles, and which are lowered for removing the formwork from the floor table 1. In this state of the floor table 1 without formwork, the floor table 1 is substantially supported on roller means 8, e.g. assembly trolleys.

The floor table 1 is to be moved out from below the concrete floor 2 towards the right hand side in the direction of a crane (not shown). When completely moved out, the floor table 1 is to be lifted onto the freshly hardened concrete floor 2 using a crane. For preparation, a crane harness 9 is mounted to the floor table 1. The crane harness 9 comprises a relocating unit 10, a front ligament 11, a rear ligament 12 and a latch shoe 13 which is mounted to the end of the rear ligament 12. The ligaments 11, 12 are e.g. formed as steel cables or preferably as steel chains.

The front ligament 11 comprises a central support ligament and a central control ligament between the relocating unit 10 and a first linking point 14 which will be explained below with reference to FIG. 6. The front ligament extends in the form of a single ligament for a short distance between the first linking point 14 and a second linking point 15. The front ligament 11 branches into two front partial ligaments 16 and 17 at the second linking point 15. The front partial ligaments 16 and 17 are mounted to front holders 18, 19 on the floor table 1. The front holders 18, 19 are easily accessed from a front working platform 20.

The rear ligament 12 also comprises a central support ligament and a central control ligament between the relocating unit 10 and a third linking point 21. The rear ligament 12 extends in the form of one single ligament between the third linking point 21 and the latch shoe 13.

The central control ligament of the front ligament 11 and the central control ligament of the rear ligament 12 form one single, continuous connected ligament. The central support ligament of the front ligament 11 and the central support ligament of the rear ligament 12 also form one single, continuous, connected ligament.

A guiding chord 22 is mounted to the latch shoe 13. The guiding chord 22 may e.g. be a braided plastic rope. The guiding chord 22 pulls the latch shoe 13 over the position of a bollard which can be extended from the floor table 1. The bollard is not shown in FIG. 1 (see FIGS. 3 and 4). The latch shoe 13 thereby slides along the formwork surface 4 of the floor table 1, between the upper side of the floor table 1 and the lower side of the concrete floor 2. The bollard acts as a rear holder 23 for the rear ligament 12. The latch shoe 13 is mounted to the floor table 1 by means of the bollard without any horizontal displacement of the floor table 1 after removing the formwork and without a technician having to climb onto the upper side of the floor table 1. When using the rear holder 23, only the bollard is extended and retracted from the lower side of the floor table 1 and the latch shoe 13 is positioned using the guiding chord 22 and optionally further guiding chords. The guiding chord 22 may be operated by a technician, in particular, from a rear working platform 24.

A rear working platform 24 is shown in a folded-down state which facilitates transport of the floor table 1.

The rear ligament 12 bends in the region of a right-hand, front edge 25 of the concrete floor 2. A deflecting device 26 is mounted at this location, along which the rear ligament 12 can slide with little friction. The deflecting device 26 has lateral guiding sheets which prevent displacement of the rear ligament 12 parallel to the edge 25.

In the state of the crane harness 9 shown in FIG. 1, one can start to move the floor table 1 to the right hand side from below the concrete floor 2. The relocating unit 10 is connected to the crane (not shown) whose lifting force pulls the relocating unit 10 upwards in the direction of arrow 27. In addition to a possibly required pivoting motion, the crane may also displace the relocating unit 10 in a horizontal direction, in particular towards the right (direction of arrow 28) through moving the so-called "cat" along its extension arm, wherein the force exerted by the crane must be small for safety reasons. The front ligament 11 is tightened and the crane holds the right-hand, front part of the floor table 1 via the front holders 18, 19. The support elements 7 are retracted to such an extent that the floor table is supported only on the roller means 8.

In accordance with the invention, the floor table 1 is extended by lifting the relocating unit 10 in the direction of arrows 27. The floor table 1 is thereby initially slightly lifted at the front holders 18, 19. At the same time, a force engages the rear holder 23 via the deflected rear ligament 12, pulling the floor table 1 in a horizontal direction towards the right. As a result, the floor table 1 starts to roll on the roller means 8 towards the right.

To prevent further lifting of the right end of the floor table 1, a ligament connected to the rear ligament 12 is then gradually guided through the relocating unit 10. The rear ligament 12 is thereby shortened and the front ligament 11 is extended. For this reason, the right-hand front end of the floor table 1 can be kept at a constant height despite further lifting of the relocating unit 10, and the floor table remains in its horizontal orientation. Control of the ligament extending through the relocating unit 10 is sufficient to always keep the floor table 1 in a constant horizontal orientation during extraction. The control may be performed manually by a technician who observes the floor table 1. Data about the inclination of the floor table 1 is alternatively supplied from an electronic level to an electronics, and the passage is automatically controlled. The electronic levels are installed on the floor table 1.

As soon as the floor table 1 has been moved out to a sufficient extent that the rear ligament 12 no longer contacts the deflecting device 26, i.e. the rear ligament 12 no longer bends, the relocating unit 10 is moved over the center of gravity of the floor table 1. Towards this end, the ligament connected to the rear ligament 12 is guided through the relocating unit 10. If the rear ligament 12 again abuts the deflecting device 26, the relocating unit 10 is moved in the direction of arrow 28 using the crane. Only the rolling friction of the roller means 8 is thereby overcome. As soon as the center of gravity of the floor table 1 is directly below the relocating unit 10, the crane can hold the floor table 1 on its own, and the roller means 8 can be disassembled or folded down. If the roller means 8 is rigidly connected to the floor table 1, the crane can pivot the floor table 1 in a horizontal direction without any danger to such an extent that the roller means 8 moves beyond the right-hand edge of the floor 3, i.e. the horizontal orientation of the floor table 1 remains.

Figure 2:
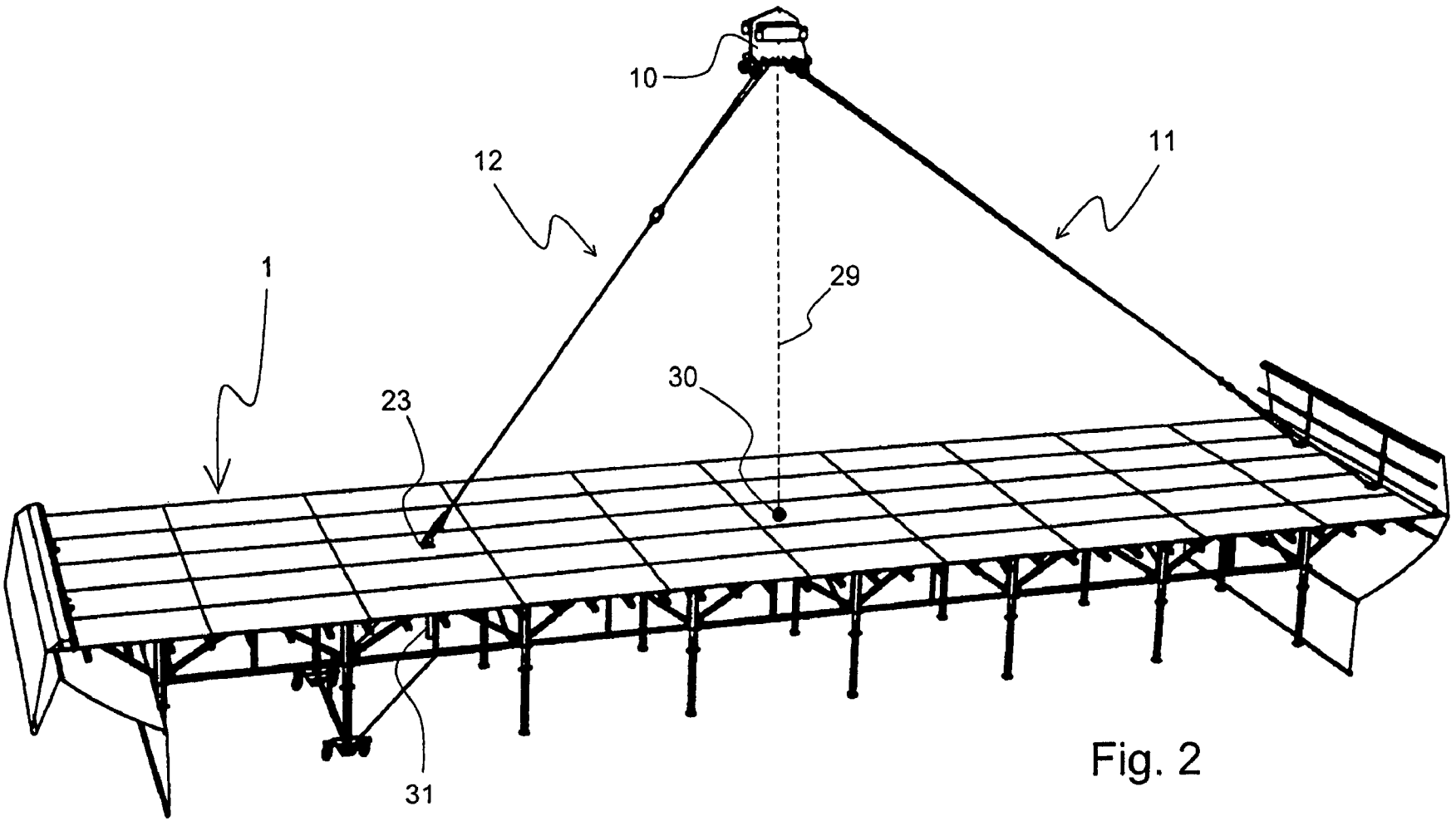
FIG. 2 shows a schematic view of an inventive floor table fastened to a crane harness, in the completely extracted state.

FIG. 2 shows the floor table 1 which is held by the front ligament 11 and the rear ligament 12. The relocating unit 10 is on a vertical line 29 above the center of gravity 30 of the floor table 1. In contrast to FIG. 1, which shows the start of the extension process, the front ligament 11 is extended and the rear ligament 12 is shortened.

FIG. 2 also shows the lower part of a bollard 31 which belongs to the mechanism of the rear holder 23.

The crane can move and dispose the floor table 1 in a conventional manner, e.g. on the upper side of the freshly hardened concrete floor.

To simplify handling of the relocating unit 10, the relocating unit 10 comprises floor rollers to permit manual displacement of the relocating unit 10 by technicians, e.g. on a hardened concrete floor.

Figure 3:
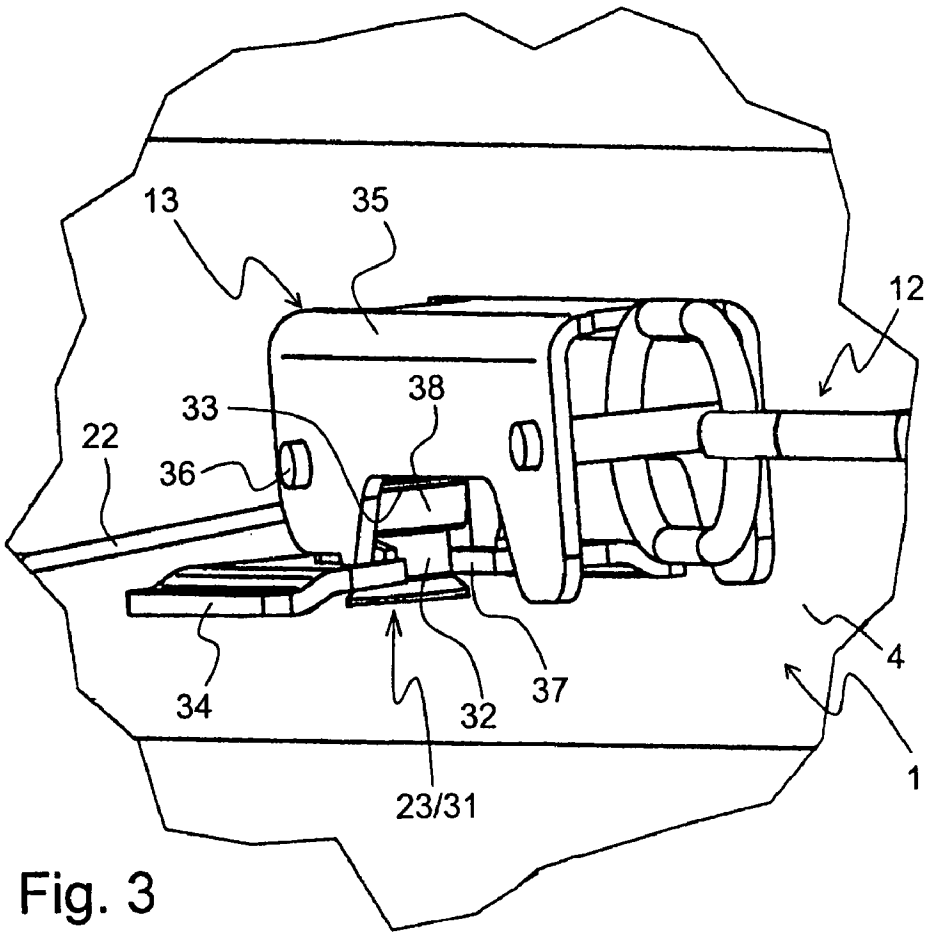
FIG. 3 shows a latch shoe of an inventive device for displacing a floor table, wherein the upper end of a bollard of an inventive floor table is inserted, and wherein an upper part of the latch shoe is pivoted downwards.

FIG. 3 shows the latch shoe 13 and the upper part of the bollard 31 in the extended position. The bollard 31 substantially forms the rear holder 23 of the floor table 1. The upper part of the bollard 31 has a constriction 32. The upper side 33 of the bollard 31 is flat and parallel to the surface of the formwork surface 4 of the floor table 1. The bollard 31 is partially extended from the upper side of the floor table 1. In the retracted state of the bollard 31, its upper side 33 would terminate flush with the formwork surface 4 of the floor table 1.

The latch shoe 13 comprises a lower part 34 and an upper part 35. The lower part 34 abuts the upper side of the floor table 1. The upper part 35 is pivotably connected to the lower part 34 via an axis 36. The upper part 35 is in the lowered state. The guiding chord 22 is mounted to a rear end of the latch shoe 13 facing away from the viewer of FIG. 3. The end of the rear ligament 12 is mounted to the front end of the latch shoe 13. The rear ligament 12 is formed by a steel chain.

The bollard 31 is inserted into the latch shoe 13. The bollard 31 thereby projects through a recess 37 of the lower part 34 of the latch shoe 13. The width of the recess 37 is selected such that the bollard 31 can project through it in the region of the constriction 32 but not in the region of a head 38 of the bollard 31. The recess 37 is open only in the direction towards the rear ligament 12.

Figure 4:
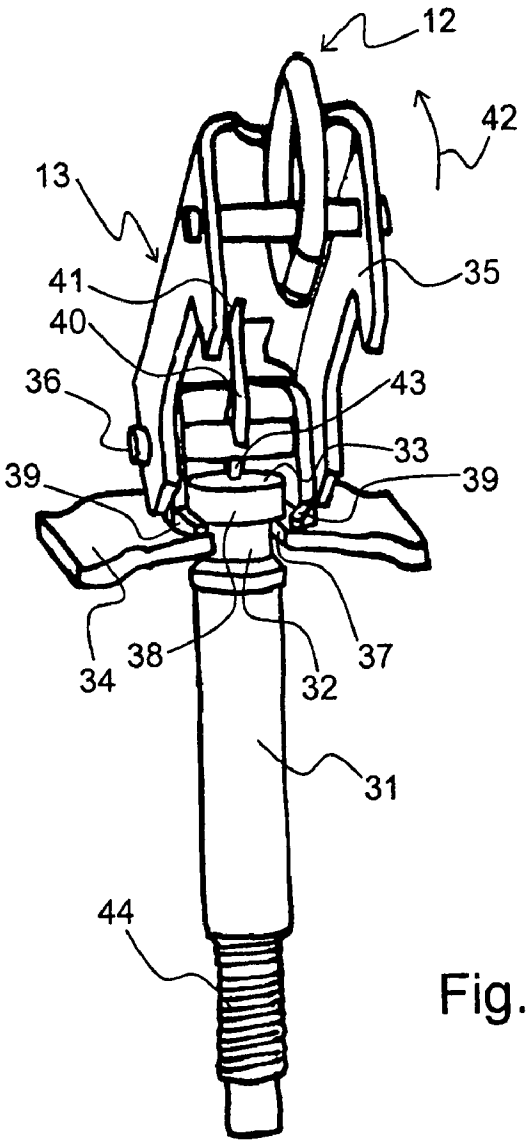
FIG. 4 shows a latch shoe of an inventive device for displacing a floor table, wherein the upper end of a bollard of an inventive floor table is inserted, and wherein an upper part of the latch shoe is largely pivoted upwards.

The mounting mechanism of the bollard 31 in the latch shoe 13 is explained in more detail with reference to FIG. 4.

The bollard 31 can be inserted from the front (i.e. from the side of the rear ligament 12) into the recess 37 and be guided out in the opposite direction when the bollard 31 is at a suitable relative height with respect to the lower part 34 of the latch shoe 13. Towards this end, the head 38 of the bollard 31 must be at such a level that the lower edges of the head 38 can be guided over projections 39 of the lower part 35. The height of the recess 37 plus the height of the projections 39 is smaller than the height of the constriction 32.

When the constriction 32 of the bollard 31 is in the recess 37, but the lower edge of the head 38 of the bollard 31 is below the upper edge of the projections 39, the bollard 31 cannot be horizontally displaced out of the latch shoe 13. This bollard position may be achieved and secured by lowering the bollard 31 in the inserted state to a maximum degree such that the lower edge of the head 38 is supported on the lower part 34. If the bollard height is fixed (e.g. from the lower side of the floor table), the bollard 31 and the latch shoe 13 cannot be separated and the rear holder is safely mounted to the rear ligament 12.

During conventional use of the rear holder, a tensile force is always exerted onto the latch shoe 13 in the direction of the rear ligament 12. This constantly forces the bollard 31 against the closed rear side of the recess 37 such that inadvertent release of the mounting is impossible.

The security of the mounting can be further increased by a securing pin 40, also called a holding-down clamp. The safety pin 40 is moved together with the upper part 35. In the embodiment shown, it is connected to the upper part 35 at the connecting point 41 and disposed to be rotatable about the axis 36.

When the upper part 35 is pivoted down to the floor table (FIG. 3), the securing pin 40 has no function. If the upper part 35 is pivoted upwards in the direction of arrow 42, one end section 43 of the securing pin 40 is lowered and exerts a force onto the upper side 33 of the bollard 31. This forces the bollard 31 into the position in which it cannot be horizontally displaced. The end section 43 is preferably rounded such that it always holds the bollard 31 in the position with maximum retraction above a limit pivoting angle of the upper part 35, i.e. in the position in which the lower edge of the head 38 abuts the upper side of the lower part 34. The above-mentioned limit angle is selected such that the position of the upper part 35 assumed when the floor table is suspended only via the crane, produces an angular position of the upper part 35 above the limit angle which is in the safe range. Typical limit angles are in a range of between 20 and 60 degrees, measured between the upper side of the floor table and the rear ligament 12 in the region of the rear holder.

A thread 44 is disposed at the lower end of the bollard 31 for extending and retracting the bollard 31 out of and into the floor table.

Figure 5:
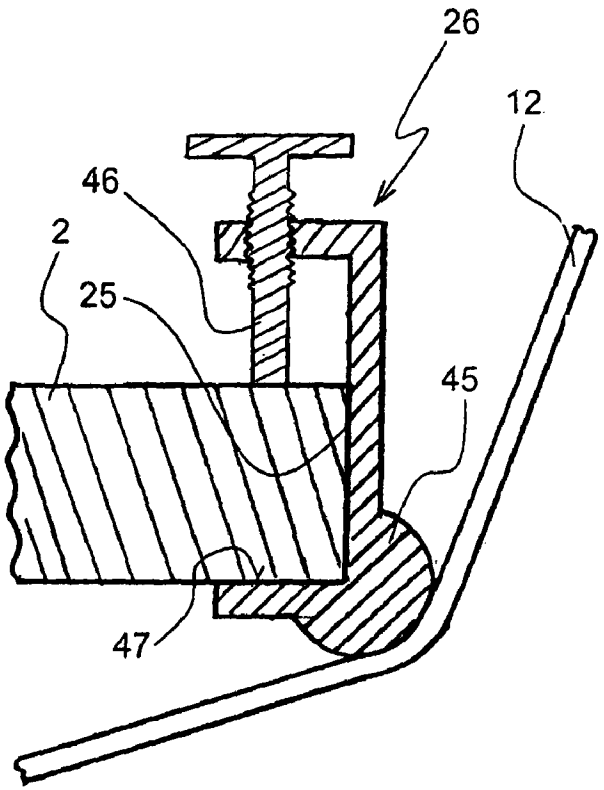
FIG. 5 shows a cross-section through a deflecting device for mounting to an edge of a hardened concrete floor which is part of an inventive device for displacing a floor table.

FIG. 5 shows a cross-section through a deflecting device 26 which guides the rear ligament 12 of the crane harness from the relocating unit to the rear holder (see FIG. 1).

The deflecting device 26 comprises a round deflecting cylinder 45 at the front lower corner edge, which faces the rear ligament 12. The rear ligament 12 can slide along the deflecting cylinder 45 with low friction. The material of the deflecting cylinder 45 corresponds to the material of the rear ligament 12 or is preferably even harder. Steel is particularly preferred. The deflecting device 26 prevents direct contact between the rear ligament 12 and the concrete of the concrete floor 2 which would cause wear. This protects the links of the rear ligament 12 and the edge of the concrete floor 2. It should be noted that the rear ligament 12 comprises several individual ligaments, i.e. a central support ligament and a central control ligament which both extend along the deflecting cylinder 45.

The deflecting device 26 is mounted to the edge 25 of the hardened concrete floor 2 facing the relocating unit (or crane). It is mounted using a screw bolt 46 which engages the upper side of the concrete floor 2 and a counter surface 47. The concrete floor 2 is clamped between the screw bolt 46 and the counter surface 47 in a reversible and damage-free fashion.

Figure 6:
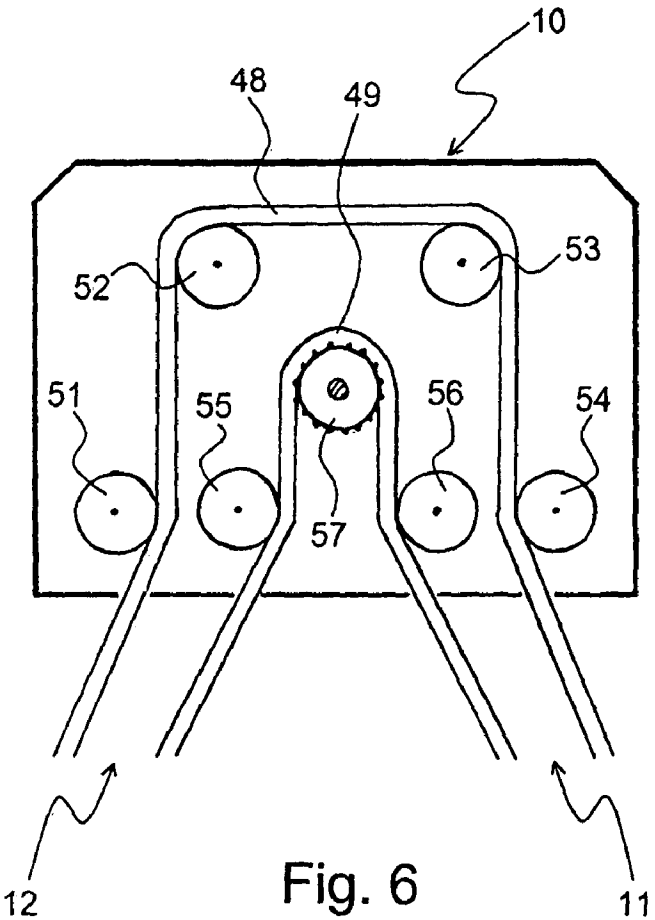
FIG. 6 shows a cross-section through a relocating unit for a central support ligament and a central control ligament which is part of the inventive device for displacing a floor table.

FIG. 6 shows a schematic cross-sectional diagram of a relocating unit 10. The front ligament 11 and the rear ligament 12 are connected via the relocating unit 10 to a crane (not shown) which holds and displaces the relocating unit 10 from above.

The front ligament 11 and the rear ligament 12 each have two individual ligaments, i.e. a central support ligament 48 and a central control ligament 49. The front and rear ligaments 1, 12 or the associated central support ligaments 48 and the central control ligaments 49 are combined in the relocating unit 10 (a better descriptive term would be connecting ligaments). Physically seen, there are a connected central support ligament 48 and a central control ligament 49.

The central support ligament 48 and the central control ligament 49 are connected to each other at their ends in the first connecting point and third linking point (only shown in FIG. 1, reference numerals 14, 21).

The central support ligament 48 is guided through the relocating unit 10 via four deflecting rollers 51, 52 53, 54. A first part of the weight of the floor table acting on the ligaments 11, 12 is transferred to the relocating unit 10 via the upper deflecting rollers 52, 53 or their suspensions. The central support ligament 48 passes through the relocating unit 10 without being braked.

The central control ligament 49 is guided to a drive 57 via two deflecting rollers 55, 56. The drive 57 has a transmission shaft with suitable surface roughness (e.g. a toothed surface engaging into links) to produce slip-free contact with the central control ligament 49. The drive 57 transmits a second part of the weight of the floor table acting on the ligaments 11, 12 to the relocating unit 10. The weight is distributed between the central control ligament 49 and the central support ligament 48, reducing the weight on the central control ligament 49 and mechanically relieving the drive 57. The ligament length between the front ligament 11 and the rear ligament 12 can be changed by the drive 57 (e.g. a transmission and/or motor). Only the central control ligament 49 is thereby actively moved by the drive 57. The central support ligament 48 just slides along via the deflecting rollers 51 through 54 corresponding to the passage of the central control ligament 49 through the relocating unit 10.

A floor table of a concrete formwork for producing a concrete floor has holders for connecting a crane harness for handling and displacing the floor table. All holders required for handling and displacing the floor table can be connected to ligaments of the crane harness even when the floor table is disposed directly below (in particular maximally 50 cm below) a freshly hardened concrete floor, and it is not possible for a technician to step onto the upper side of the floor table.

I claim:

1. A method for displacing a floor table, the method comprising the steps of:

a) removing a formwork from the floor table after a concrete floor has hardened and lowering the floor table onto at least one roller means;

b) mounting at least one front ligament and at least one rear ligament to corresponding front and rear holders of the floor table when the floor table has been retracted from below the hardened concrete floor;

c) withdrawing the floor table, supported on the at least one roller means, from below the hardened concrete floor using a crane, wherein the crane keeps the front ligament tightened at a constant length, thereby ensuring a substantially horizontal orientation of the floor table;

d) tightening the rear ligament as soon as the hardened concrete floor no longer projects past the rear holder and subsequently gradually shortening the rear ligament and/or gradually extending the front ligament thereby gradually displacing a relocating unit to a center of gravity of the floor table, wherein shortening and/or extension are controlled to keep the floor table in a substantially horizontal orientation; and e) moving, using the crane, the floor table out of the finished storey for further use as soon as the relocating unit has reached a position above the center of gravity of the floor table such that no load acts on the roller means and disposing the floor table onto the hardened concrete floor to produce a further storey.

2. The method of claim 1 wherein the floor table comprises:

a formwork surface for supporting the formwork during molding of the concrete floor;

a front holder cooperating with the floor table at said formwork surface and structured to cooperating with the front ligament; and a rear holder cooperating with the floor table at said formwork surface and structured to cooperating with the rear ligament, wherein said rear holder comprises a bollard and means for displacing said bollard out of said formwork surface towards the concrete floor, the bollard having a constriction or thickening in an end region thereof facing the concrete floor, wherein said front and said rear holders are accessible to fasten the front and the rear ligaments in a retracted state of the floor table, without formwork, and disposed directly below a freshly hardened concrete floor.

3. The method of claim 2, wherein said bollard has an upper side which is flush with said form work surface in a retracted state of said bollard.

4. The method of claim 2, wherein said front and said rear holders of the floor table are accessible to fasten the front and rear ligaments when the floor table is lowered relative to the concrete floor by 50 cm or less.

5. The method of claim 4, wherein said front and said rear holders of the floor table are accessible to fasten the front and rear ligaments when the floor table is lowered relative to the concrete floor by 30 cm or less.

6. The method of claim 2, wherein the floor table has at least one working platform on an edge side thereof, wherein at least one of said front and said rear holders is disposed in a region of said at least one working platform.

7. The method of claim 2, wherein said formwork surface of the floor table is structured at a side of the floor table facing away from the concrete floor to allow a ligament of the crane harness to be guided and mounted to a further holder disposed on a side of the floor table facing away from the concrete floor.

8. The method of claim 7, further comprising a deflecting device mounted to one edge of the floor table.

9. The method of claim 2, wherein at least one of said front and said rear holders is disposed on a side of the floor table.

10. The method of claim 1, wherein, during step b), at least one guiding chord is mounted to an end of the rear ligament, and the end of the rear ligament is pulled by the at least one guiding chord towards the rear holder and/or is oriented relative to the rear holder.

11. A device for displacing a floor table, the device comprising:

means for removing a formwork from the floor table after a concrete floor has hardened and for lowering the floor table onto at least one roller means;

means for mounting at least one front ligament and at least one rear ligament to corresponding front and rear holders of the floor table when the floor table has been retracted from below the hardened concrete floor;

means for withdrawing the floor table, supported on the at least one roller means, from below the hardened concrete floor, wherein said withdrawing means keeps the front ligament tightened at a constant length, thereby ensuring a substantially horizontal orientation of the floor table;

means for tightening the rear ligament as soon as the hardened concrete floor no longer projects past the rear holder and subsequently gradually shortening the rear ligament and/or gradually extending the front ligament thereby gradually displacing a relocating unit to a center of gravity of the floor table, wherein shortening and/or extension are controlled to keep the floor table in a substantially horizontal orientation; and means for moving the floor table out of the finished storey for further use as soon as the relocating unit has reached a position above the center of gravity of the floor table such that no load acts on the roller means and for disposing the floor table onto the hardened concrete floor to produce a further storey, wherein a crane harness withdraws the floor table from beneath the finished concrete floor, the crane harness cooperating with said at least one front ligament and with said at least one rear ligament, the crane harness being suspended from a relocating unit, said relocating unit having means for shortening said at least one rear ligament, and further comprising a deflecting device structured and dimensioned for mounting to an edge of the hardened concrete floor, wherein at least one latch shoe cooperates with an end of said front and/or said rear ligament, said latch shoe comprising a lower part having a recess structured to engage below a thickening or around a constriction in a bollard cooperating with said floor table, said latch shoe having a projection which arrests said bollard after insertion thereof into said recess.

12. The device of claim 11, wherein said relocating unit comprises means for extending said at least one front ligament.

13. The device of claim 11, wherein said at least one front ligament and said at least one rear ligament are connected to each other via a connecting ligament running through said relocating unit, said relocating unit further comprising a drive for controlling passage of said connecting ligament.

14. The device of claim 13, wherein said connecting ligament comprises a central control ligament in a region of said relocating unit, a passage of which through said relocating unit being controlled by said drive, and further comprising a central support ligament which runs through said relocating unit via deflecting devices and without being braked.

15. The device of claim 11, further comprising an electronic horizontal sensor structured and dimensioned for mounting to the floor table, wherein said shortening means and said drive can be controlled via information from said electronic horizontal sensor to regulate a horizontal orientation of a floor table.

16. The device of claim 11, wherein said front ligament is branched into several partial ligaments for mounting to a corresponding plurality of front holders of the floor table.

17. The device of claim 11, wherein said rear ligament is branched into a plurality of rear partial ligaments for mounting to a corresponding plurality of rear holders of the floor table.

18. The device of claim 11, wherein at least one of said front and said rear ligaments comprise steel chain.

19. The device of claim 11, wherein said latch shoe comprises an upper part which is pivoted upward relative to said lower part in a mounted state via a tensile load of a respective ligament mounted to said latch shoe, said latch shoe further comprising a safety pin, wherein, in an upwardly pivoted state of said upper part, said safety pin arrests an inserted bollard.

20. A method for operating the device of claim 11, the method comprising the steps of:

a) removing the form work from the floor table when the concrete floor has hardened and lowering the floor table onto at least one roller means;

b) installing the deflecting device on the edge of the hardened concrete wall facing the crane and mounting the at least one front ligament and the at least one rear ligament in respective front and rear holders of the floor table after the floor table has been retracted below the hardened concrete floor;

c) pulling the relocating unit upwards using the crane such that the rear ligament slides on the installed deflecting device, wherein the floor table automatically moves out from below the hardened concrete floor and controlling at least the means for shortening the rear ligament in such a manner that the floor table remains in a substantially horizontal orientation;

d) radially shortening the rear ligament and/or gradually extending the front ligament as soon as the rear ligament loses contact with the deflecting device, wherein, the relocating unit is gradually displaced to the center of gravity of the floor table, with shortening and/or extending being controlled in such a manner that the floor table remains substantially horizontally oriented; and e) moving, using the crane, the floor table out of the finished storey for further use as soon as the relocating unit has reached a position above the center of gravity of the floor table and no load acts on the roller means, disposing the floor on the hardened concrete floor to produce a further storey, and subsequently removing the installed deflecting device.

21. The method of claim 20, wherein, during step b), at least one guiding chord is mounted to an end of the rear ligament, and the end of the rear ligament is pulled by the at least one guiding chord towards the rear holder and/or is oriented relative to the rear holder.

* * * * *